United States Patent [19]

Klimeck et al.

[11] Patent Number: 4,516,809

[45] Date of Patent: May 14, 1985

[54] DEVICE FOR INTERCONNECTING TWO SECTIONS OF A LONGWALL MINING MACHINE TRACK

[75] Inventors: Hugo Klimeck, Velbert; Gerhard Wilken, Bochum, both of Fed. Rep. of Germany

[73] Assignee: Gebr. Eickhoff Maschinenfabrik und Eisengiesserei m.b.H., Bochum, Fed. Rep. of Germany

[21] Appl. No.: 530,254

[22] Filed: Sep. 8, 1983

[30] Foreign Application Priority Data

Sep. 21, 1982 [DE] Fed. Rep. of Germany ..... 3234888

[51] Int. Cl.[3] ..... E21C 35/12

[52] U.S. Cl. ..... 299/43; 299/34

[58] Field of Search ..... 299/32, 34, 42, 43

[56] References Cited

U.S. PATENT DOCUMENTS

| | | | |
|---|---|---|---|
| 4,067,619 | 11/1978 | Peters et al. | 299/43 |
| 4,162,810 | 7/1979 | Oberste-Beulmann | 299/43 |
| 4,205,882 | 6/1980 | Hauschopp et al. | 299/43 |
| 4,265,488 | 5/1981 | Schupphaus et al. | 299/43 |
| 4,391,471 | 7/1983 | Hauschopp et al. | 299/43 |

FOREIGN PATENT DOCUMENTS

| | | | |
|---|---|---|---|
| 47811 | 11/1978 | Fed. Rep. of Germany | 299/43 |

*Primary Examiner*—Stephen J. Novosad
*Assistant Examiner*—William P. Neuder
*Attorney, Agent, or Firm*—Thomas H. Murray

[57] ABSTRACT

A device for interconnecting two sections of a longwall mining machine secured to the side wall of a face conveyor, characterized in that lugs project outwardly from the sides of adjacent end portions of the respective track sections and receive an oval chain link securing element which extends around the lugs and bridges the joint between the respective track sections.

The chain link element has horizontally-extending portions interconnecting semicircular end portions which extend around the lugs, the horizontally-extending portions being such that elongation of the interconnecting device is limited as is the separation between adjacent end portions. This insures that the clearance between ends of adjacent track sections is sufficient to provide for the correct tooth spacing on a drive rack to accommodate the driving wheel of a mining machine.

3 Claims, 3 Drawing Figures

DEVICE FOR INTERCONNECTING TWO SECTIONS OF A LONGWALL MINING MACHINE TRACK

BACKGROUND OF THE INVENTION

The present invention relates to a device for interconnecting two sections of a longwall mining machine track secured to the side wall of a face conveyor. Lugs project outwardly from the sides of adjacent end portions of the respective track sections and receive an oval chain link element which extends around the lugs and bridges the joint between the respective track sections.

A device of the general type described above for interconnecting sections of a longwall mining machine track is shown in U.S. Pat. No. 4,265,488. That patent discloses a longwall mining machine track on which the discrete sections of the track have coupling plates disposed on their opposite ends. Projecting outwardly from each coupling plate is a lug over which a chain link coupling element is pushed, the coupling element extending around and providing an articulated connection between the discrete track sections.

In addition to interconnecting discrete sections of a track which are disposed on the face side of a longwall face conveyor, similar chain link coupling elements serve to retain the side bracket portions secured to the opposite side of the face conveyor. These chain link elements are the only elements which determine the play or slack in the face conveyor between adjacent track portions. In the case where the machine track or a side bracket has a toothed rack to advance the longwall mining machine, the clearance between the track sections always must be such that the pitch of the rack teeth at the joints between adjacent track sections can vary only within permissible limits in order to facilitate engagement of the teeth of the mining machine drive wheel with the rack at the joints.

After a longwall mining machine traverses the face area being mined and removes material therefrom, the conveyor on which it travels must be pushed or advanced toward the face for the next cutting operation. The chain link connecting elements for the discrete track sections, as well as the side bracket sections, are heavily loaded during conveyor advance, not only by transverse forces exerted in the direction of the advance but to the same extent by tensile force which act lengthwise of the face conveyor and which are produced by the advancing movement. These forces reach orders or magnitude which are sufficient to cause permanent elongation of the connecting elements, thus increasing the clearance excessively between adjacent track or side bracket sections. In the extreme case (i.e., curved portions of the face conveyor as it is advanced toward the face), the clearance between adjacent sections of track or side bracket may increase to such an extent over a period of time as to exceed the desired tooth pitch between track sections and impair engagement of the driving wheel of the mining machine with the rack.

SUMMARY OF THE INVENTION

In accordance with the present invention, a device is provided for interconnecting two end-to-end sections of a longwall mining machine track secured to the side wall of a face conveyor in which the possible elongation of the device is limited such that its maximum elongation cannot be greater than the permissible clearance between adjacent portions or sections of rack for efficient engagement with the machine drive wheel.

Like prior art fastening elements, the chain link element which secures adjacent track sections together is characterized in having horizontally-extending portions interconnecting semicircular end portions which extend around lugs extending outwardly from the respective track sections. However, in contrast to prior art devices of this type, the horizontally-extending portions are of larger cross-sectional area than the semicircular end portions whereby elongation of the interconnecting device is limited, as is the separation between adjacent end portions.

Further, in accordance with the invention, the semicircular end portions of the chain link connecting elements are each provided with a tongue which extends substantially over the height of the connecting element. These tongues, in turn, are engaged by securing elements or lugs to the mining machine track. The tongues reinforce the semicircular end portions, making them better able to withstand deformation. In addition, the tongues prevent a broken connecting element from jamming on the lateral lugs or projections of the sections. The tongues also reduce, in the semicircular end portions, elongation produced by the relatively substantial tensile forces involved. It is also possible, in one embodiment of the invention, to form the chain link element from a substance whose maximum elongation at fracture is less than the permissible clearance between adjacent sections or portions of the machine track or side bracket.

The above and other objects and features of the invention will become apparent from the following detailed description taken in connection with the accompanying drawings which form a part of this specification, and in which.

Figure 3:
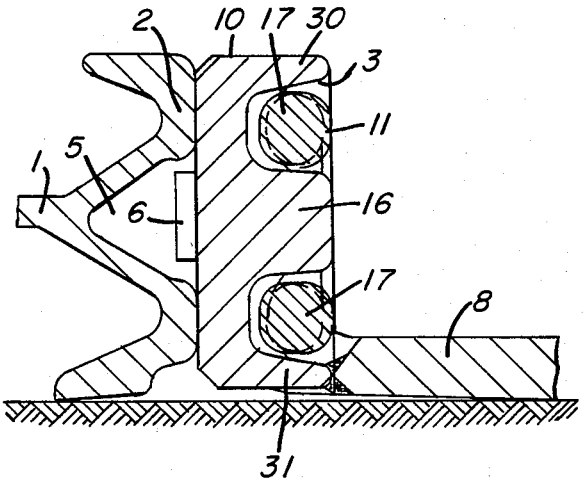
FIG. 3 is a cross-sectional view taken substantially along line C—D of FIG. 1.

With reference now to the drawings, there is shown a face conveyor 1 for a longwall mining machine, not shown, which carries on its face-side wall 2 a machine track 3 secured to the conveyor by fasteners along the length of a section of conveyor trough. As shown in FIG. 3, the side wall 2 of the conveyor 1 is formed with a V-shaped recess 5 which receives metal locking flats 6 on the back of track 3 which relieve the load on the aforesaid fasteners.

The track 3 is in the form of an angle in cross section and has a vertical arm 7 (FIG. 1) secured to the conveyor side wall 2 and a lower, horizontal leg 8. The leg 8 is disposed on the mine floor and serves as a track on the face side of the conveyor for the longwall mining machine, not shown. The top edge of the vertical arm 7 is provided with a bead 9 (FIG. 1) which terminates before the boundary plane of the device interconnecting two adjacent sections of track 3.

Figure 1:
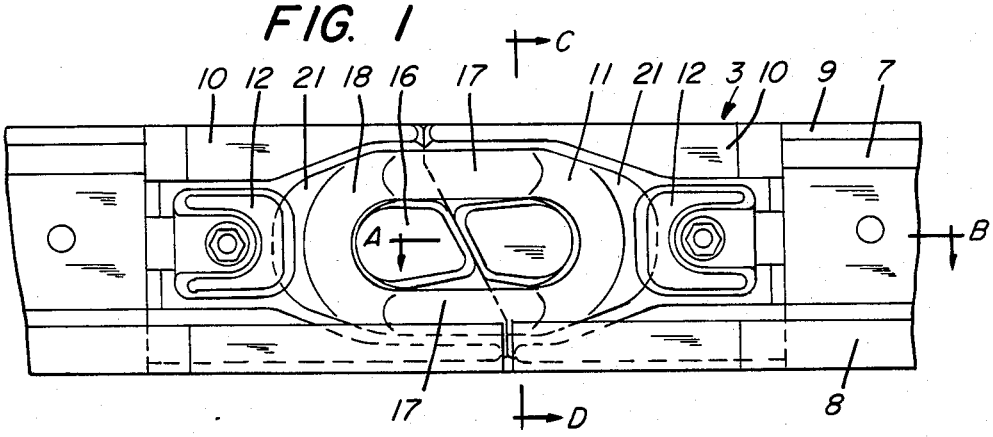
FIG. 1 is a side view of the interconnecting device of the invention.
Figure 2:
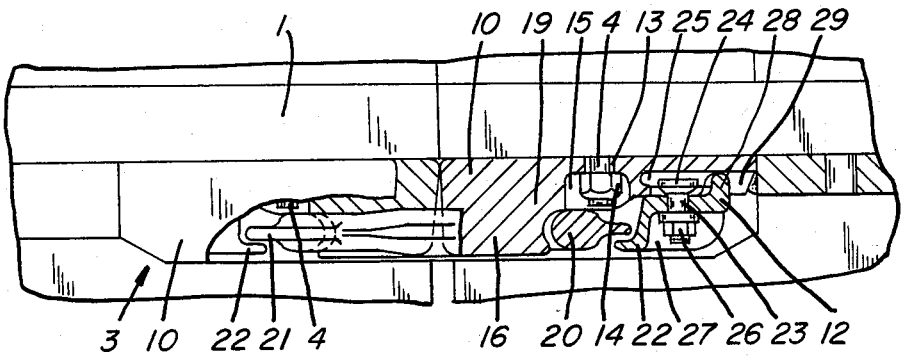
FIG. 2 is a top view of the interconnecting device of the invention, partly in section, taken substantially along line A—B of FIG. 1.

As can be seen in FIG. 1, the connecting device of the invention comprises two connecting elements 10 welded to the ends of the discrete track sections. Projecting outwardly from the sides of the elements 10 are two lugs 16; while an oval chain link connecting element 11 is passed over the lugs to secure adjacent track sections together. Each of the elements 10 is formed with a bore 13 (FIG. 2) through which a screwthreaded fastener 4 extends. The fastener 4 receives a nut 14 disposed within a recess 15 and thus connects the connecting elements 10 to the conveyor trough side wall. The upper and lower horizontal portions 17 of each chain link connecting element 11 are in cross section substantially square (FIG. 3), the square cross sections merging at the semicircular terminal portions 18 into smaller and substantially rectangular cross sections. Inner surfaces 19 of the semicircular terminal portions 18 are convex on their sides which engage the two lugs 16. As can be seen in FIGS. 2, the lugs 16 are provided with semicircular surfaces with a concavity 20 matching the convexity 19 of semicircular terminal portions 18.

Each of the two semicircular end portions 18 of the connecting element 11 is provided with a tongue 21 which extends substantially over the height of the element 11. The tongues 21 are of reduced thickness and are disposed in the plane of symmetry of the element 11. A lug 22 on a securing element 12 retained by a bolt 23 extends over an associated tongue 21 and holds the element in position over the lugs 16. As shown, the head 24 of the bolt 23 is received within a dovetail recess 25 in the element 10. Securing element 12 is retained on the bolt 23 by a self-locking hexagonal nut 26 disposed for protection within a U-shaped recess 27. Each element 12 is also provided with a lug 28 within a recess 29 in the element 10 and prevents the securing element 12, whose thickness does not project beyond the lugs 16, from rotating.

As shown in FIG. 3, the connecting elements 10 are essentially in the form of channels facing toward the leg 8. By virtue of their top and bottom arms 30 and 31, they extend closely around the securing elements 12 and cover the connecting element 11 over its entire length. As a result, nowhere does the device project above the vertical plane extending through the two flanged ends of the connecting elements 10, and the device is so disposed in the track cross section as not to project above the bead 9.

Instead of using thickened horizontal portions 17 it is possible to form the chain link connecting elements 11 from a material whose elongation just before fracture is less than the permissible clearance between track section ends to provide for the correct tooth spacing on a drive rack to accommodate the driving wheel of the mining machine.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A device for interconnecting two sections of a longwall mining machine track secured to the side wall of a face conveyor, comprising lugs projecting outwardly from the sides of adjacent end portions of the respective track sections, an oval chain link element extending around said lugs and bridging the joint between the respective track sections, and fastening elements on the track sections for securing the chain link element in place, the chain link element being characterized in having horizontally-extending portions interconnecting semicircular end portions which extend around said lugs, the horizontally-extending portions being of larger cross-sectional areas than the semicircular end portions, whereby elongation of the interconnecting device is limited as is the separation between said adjacent end portions.

2. The device according to claim 1 including tongues on each of said semicircular end portions, said tongues being engaged by said fastening elements for securing the chain link element in place as aforesaid.

3. A device for interconnecting two sections of a longwall mining machine track secured to the side wall of a face conveyor, comprising lugs projecting outwardly from the sides of adjacent end portions of the respective track sections, an oval chain link element extending around said lugs and bridging the joining between the respective track sections, and fastening elements on the track sections for securing the chain link element in place, the chain link element being characterized in being formed from a material whose elongation just before fracture is less than the permissible clearance between track section ends to provide for the correct tooth spacing on a drive rack extending along the track to accommodate the driving wheel of a mining machine.

* * * * *